US008080932B2

(12) United States Patent
Murakami et al.

(10) Patent No.: US 8,080,932 B2
(45) Date of Patent: Dec. 20, 2011

(54) ELECTRON-EMITTING DEVICE, ELECTRON SOURCE, IMAGE DISPLAY APPARATUS AND METHOD FOR MANUFACTURING ELECTRON-EMITTING DEVICE

(75) Inventors: Shunsuke Murakami, Atsugi (JP); Ryoji Fujiwara, Chigasaki (JP); Noriaki Oguri, Zama (JP); Yasushi Shimizu, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 525 days.

(21) Appl. No.: 12/114,631

(22) Filed: May 2, 2008

(65) Prior Publication Data

US 2008/0278059 A1 Nov. 13, 2008

(30) Foreign Application Priority Data

May 9, 2007 (JP) ..... 2007-124315

(51) Int. Cl.
*H01J 1/62* (2006.01)
*H01J 63/04* (2006.01)

(52) U.S. Cl. ..... 313/497; 313/495; 313/496

(58) Field of Classification Search ..... 313/495–497
See application file for complete search history.

(56) References Cited

U.S. PATENT DOCUMENTS

| | | | | |
|---|---|---|---|---|
| 5,473,218 | A | 12/1995 | Moyer | |
| 6,130,503 | A * | 10/2000 | Negishi et al. | 313/495 |
| 6,166,487 | A * | 12/2000 | Negishi et al. | 313/495 |
| 6,806,630 | B2 * | 10/2004 | Birecki et al. | 313/346 R |
| 7,109,663 | B2 | 9/2006 | Fujiwara et al. | |
| 7,259,520 | B2 | 8/2007 | Fujiwara et al. | |
| 2003/0128494 | A1 * | 7/2003 | Birecki et al. | 361/225 |
| 2004/0251812 | A1 * | 12/2004 | Fujiwara et al. | 313/495 |
| 2006/0066199 | A1 | 3/2006 | Ichikawa et al. | |
| 2006/0125370 | A1 * | 6/2006 | Nishimura et al. | 313/310 |

FOREIGN PATENT DOCUMENTS

| | | |
|---|---|---|
| JP | 8-55564 | 2/1996 |
| JP | 2004-71536 | 3/2004 |
| JP | 2005-26209 | 1/2005 |

* cited by examiner

*Primary Examiner* — Nimeshkumar Patel
*Assistant Examiner* — Thomas A Hollweg
(74) *Attorney, Agent, or Firm* — Fitzpatrick, Cella, Harper & Scinto

(57) ABSTRACT

An electron-emitting device of the present invention has an electron-emitting film, and the electron-emitting film is composed of a first layer made of a first material, and a plurality of particles made of a second material whose electric resistivity is lower than that of the first material and provided into the first layer. The first material contains oxygen and nitrogen. A method for manufacturing the electron-emitting device according to the present invention has a step of forming the electron-emitting film, and the electron-emitting film forming step includes a step of forming the plurality of particles made of a second material whose electric resistivity is lower than that of a first material into the first layer made of the first material containing oxygen and nitrogen.

9 Claims, 9 Drawing Sheets

ELECTRON-EMITTING DEVICE, ELECTRON SOURCE, IMAGE DISPLAY APPARATUS AND METHOD FOR MANUFACTURING ELECTRON-EMITTING DEVICE

BACKGROUND OF THE INVENTION

1. Field of the Invention

The present invention relates to an electron-emitting device having an electron-emitting film, an electron source, an image display apparatus, and a method for manufacturing the electron-emitting device.

2. Description of the Related Art

Field emission type (hereinafter, "FE" type) electron-emitting devices are known. Japanese Patent Application Laid-Open Nos. 2004-071536 (US 2006/0066199A1), 8-055564 (U.S. Pat. No. 5,473,218), and 2005-26209 (U.S. Pat. Nos. 7,109,663; 7,259,520) disclose FE type electron-emitting devices having a flat electron-emitting film and a gate electrode with an opening (so-called "gate hole"). In the electron-emitting devices having such a flat electron-emitting film, since a relatively flat equipotential surface is formed on a surface of the electron-emitting film, spread of electron beams becomes small.

The electron-emitting devices used in image display apparatuses require stable electron emission in order to secure reliability such as brightness uniformity of display images. Specifically, ideal properties are such that (1) electron emission characteristics of all the electron-emitting devices are uniform, and (2) an amount of electron emission does not fluctuates over time (that is, no fluctuation of an amount of electron emission is caused).

Like Japanese Patent Application Laid-Open No. 2004-071536 (US 2006/0066199A1), however, an electron-emitting film which contains a lot of metal particles possibly causes a characteristic change (change in electric resistance) due to a heat according to some particle sizes of the metal particles. For this reason, the electric resistance of the individual electron-emitting films changes at a heating step of a manufacturing process, and the electron emission characteristic occasionally varies. Further, when an image display apparatus is driven for a long time, the electric resistance of the electron-emitting film changes due to heat generation of the device itself and an influence of another heating element in the apparatus, and the amount of electron emission might fluctuate. According to studies and considerations by the inventors, as the particle size of the metal particles in the electron-emitting film is smaller, the characteristic change due to such a heat becomes more noticeable. In Japanese Patent Application Laid-Open No. 2004-071536 (US 2006/0066199A1), a carbon film containing a lot of cobalt particles is formed in such a manner that a film which includes cobalt and carbon is formed on a substrate by co-sputtering graphite and cobalt targets, and the cobalt is agglomerated by heating the film at high temperature. Conventionally, complicated steps are occasionally required for forming electron-emitting films containing particles, and preferable control of particle sizes is difficult in some constitutions (materials) of the electron-emitting films.

SUMMARY OF THE INVENTION

It is an object of the present invention to provide an electron-emitting device having an electron-emitting film having a stable characteristic against a heat and capable of emitting electrons stably, an electron source, an image display apparatus, and a simple method for manufacturing them.

It is another object of the present invention to provide a technique which facilitates control of particle size of particles in the electron-emitting film.

According to a first aspect of the present invention, an electron-emitting device includes an electron-emitting film. The electron-emitting film has a first layer made of a first material, and a plurality of particles, which is made of a second material whose electric resistivity is lower than that of the first material and is provided in the first layer, and the first material is a material containing oxygen and nitrogen.

According to a second aspect of the present invention, an electron source includes a plurality of electron-emitting devices. The electron-emitting device is the electron-emitting device according to the first aspect.

According to a third aspect of the present invention, an image display apparatus includes: an electron source; and a light-emitting member which emits light by means of electrons emitted from the electron source. The electron source is the electron source according to the second aspect.

According to a fourth aspect of the present invention, a method for manufacturing an electron-emitting device, includes a step of forming an electron-emitting film. The electron-emitting film forming step includes a step of forming a plurality of particles made of a second material whose electric resistivity is lower than that of a first material in a first layer made of the first material containing oxygen and nitrogen.

According to the present invention, the electron-emitting device which has the electron-emitting film which has a stable characteristic against a heat and can emit electrons stably, the electron source, the image display apparatus and the manufacturing method for them can be provided. Further, the control of the particle size of the particles in the electron-emitting film is facilitated, so that a larger particle size can be obtained stably and easily.

Further features of the present invention will become apparent from the following description of exemplary embodiments with reference to the attached drawings.

DESCRIPTION OF THE EMBODIMENTS

Preferable embodiments of the present invention are exemplarily described in detail below with reference to the drawings. The scope of the present invention is not limited to dimensions, material quality, shapes and relative positions of components described in the following embodiment unless otherwise noted.

<Basic Constitution of the Electron-Emitting Device>

Figure 1:
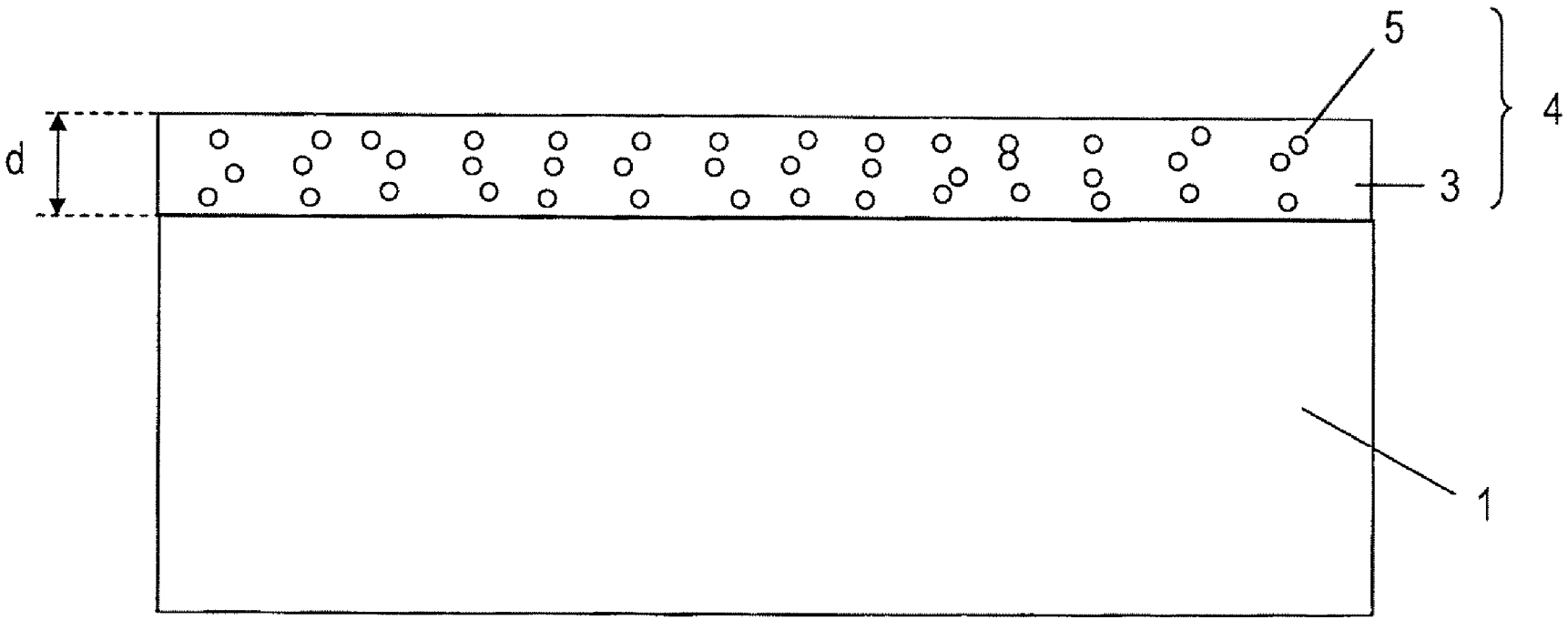
FIG. 1 is a sectional view schematically illustrating a basic constitution of an electron-emitting device.

FIG. 1 is a sectional view schematically illustrating an electron-emitting device. The electron-emitting device has an electron-emitting film 4 which is arranged on a surface of a substrate 1. The electron-emitting film 4 has at least a base material layer (first layer) 3 and a plurality of particles 5 provided in the base material layer 3. When the electron-emitting film 4 is provided directly on the substrate 1 as shown in FIG. 1, the electron-emitting film 4 itself can function also as an electrode (cathode electrode). Preferably, a conductive layer is provided between the substrate 1 and the electron-emitting film 4. In this case, the conductive layer functions as an electrode (cathode electrode).

A material of the base material layer 3 is different from a material of the particles 5. A material with high resistivity (preferably, an insulating material) is used for the base material layer 3, and a material (preferably, conductive material) with electric resistivity lower than that of the material of the base material layer 3 is used for the particles 5.

In this embodiment, a material containing oxygen and nitrogen is used as the material (first material) of the base material layer 3. As "the material containing oxygen and nitrogen", oxynitride (for example, SiOxNy, AlOxNy or GeOxNy is preferable) is typically used, but oxide doped with nitrogen (nitrogen-doped oxide) or nitride doped with oxygen (oxygen-doped nitride) may be used. Further, two or more materials of oxynitride, nitride-doped oxide and oxygen-doped nitride may be mixed in the base material layer 3. A present ratio of oxygen element (O) and nitrogen element (N) in the electron-emitting film 4 is suitably determined depending on the material of the particles 5. It is preferable that about several dozen atm % of O and N are present with respect to the entire electron-emitting film 4. Practically, the percentage of oxygen with respect to the entire electron-emitting film 4 is preferably not less than 20 atm % and not more than 30 atm %, and the percentage of nitrogen with respect to the entire electron-emitting film 4 is not less than 10 atm % and not more than 20 atm %.

As the material (second material) of the particles 5, a material, which hardly makes solid solution with the material of the base material layer 3 and becomes particles in self-alignment by a combination with the material of the base material layer 3, can be used, preferably. Examples of such materials are Au, Ag, Pt, Si, Ge, C, Pd, Cu, Ir, Ru, Os or Mo, or alloy of them. Particularly, any one of Au, Ag and Ir is practically preferable. When the material of the base material layer 3 and the material of the particles 5 are selected in such a manner, in a below-described manufacturing method, an electron-emitting film having the base material layer 3 containing the particles whose particle size (diameter) is controlled can be formed by a single depositing process in a simple co-sputtering method.

The plurality of particles 5 may be arranged uniformly or randomly in the electron-emitting film 4. The density of the particles 5 in the electron-emitting film 4 may be approximately uniform or dispersed. The particles 5 may be arranged in the whole electron-emitting film 4 or only on a part of the electron-emitting film 4.

The particle size (diameter) of the particles 5 is set so as to be smaller than a film thickness d of the electron-emitting film 4. In order to reduce the change in the electric resistance due to the temperature (heat) of the electron-emitting film 4, the particle size of the particles 5 is preferably not less than 1 nm and not more than 10 nm. Since the electron-emitting film 4 is made of two materials (the base material layer 3 and the particles 5) with different electric resistivities, the balance of the two materials influences characteristics (electric characteristic, temperature characteristic) of the entire electron-emitting film. When the diameter of the particles 5 is less than 1 nm, the influence of the material characteristic of the base material layer 3 becomes strong, thereby increasing the electric resistance of the entire electron-emitting film 4. As a result, satisfactory electron emission characteristic cannot be obtained, and the characteristic easily changes due to heat. On the other hand, when the diameter of the particles 5 exceeds 10 nm, the characteristic of the entire electron-emitting film 4 greatly depends on the property of the material of the particles 5, and this is not preferable. Therefore, when the diameter of the particles 5 is set within the range of not less than 1 nm and not more than 10 nm, the desired electron emission characteristic can be maintained and simultaneously the characteristic change due to heat can be repressed.

It is conventionally difficult to stably and easily control the size of the particles 5 within a desired range (particularly, the diameter of not less than 1 nm). On the contrary, in this embodiment, "a material containing oxygen and nitrogen" is selected as the material of the base material layer 3, so that the particles 5 having the above size can be formed stably and easily.

An interval of the particles 5 in a film thickness-wise direction of the electron-emitting film 4 is preferably not more than 5 nm. The two particles 5 arranged in the film thickness-wise direction may contact with each other (namely, the interval is not less than 0 and not more than 5 nm). Even if the particles 5 contact with each other, a contact surface is small, and when the particles 5 are separated in a range of not more than 5 nm, electrons can be delivered. For this reason, it is considered that an effect for repressing a fluctuation in an electron emission current can be obtained.

The electron-emitting device in FIG. 1 has a two-layered structure of the substrate 1 and the electron-emitting film 4, but as discussed above a conductive layer is preferably provided between the substrate 1 and the electron-emitting film 4. Further, a resistive member (resistive layer) is preferably provided between the conductive layer and the electron-emitting film 4. This resistive layer is preferably formed into a film shape. For this reason, the resistive layer is called also as a resistive film.

<Example of the Electron-Emitting Device>

Figure 2A:
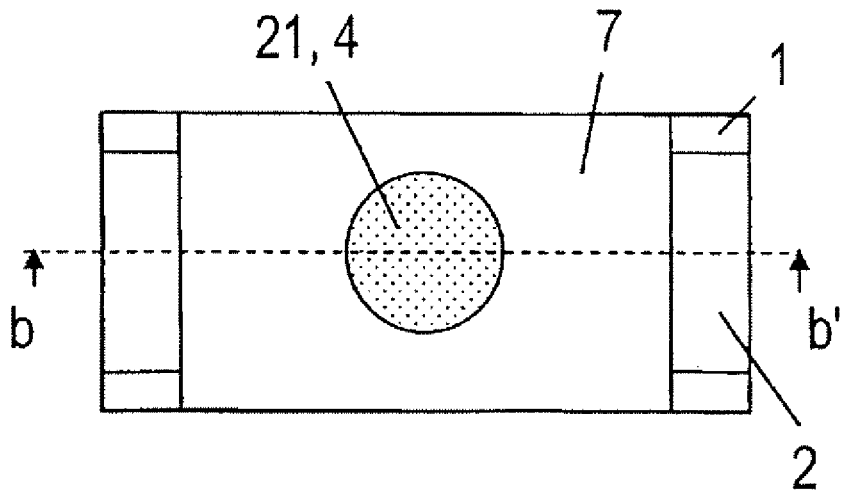
FIG. 2A is a plan view illustrating the electron-emitting device according to one embodiment.
Figure 2B:
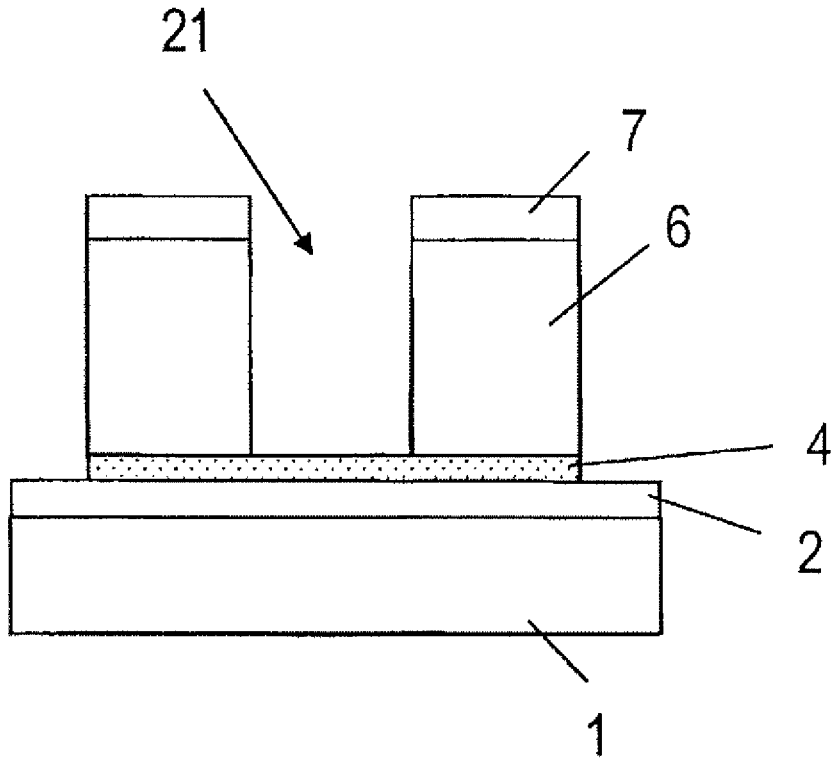
FIG. 2B is a sectional view taken along line b-b' of FIG. 2A.

FIGS. 2A and 2B illustrate the electron-emitting device according to one embodiment. FIG. 2A is a plan view, and FIG. 2B is a cross sectional view taken along line b-b' of FIG. 2A. This electron-emitting device includes the substrate 1, the conductive layer (first electrode) 2 and the electron-emitting film 4. An insulating layer 6 and a second electrode 7 are provided on the electron-emitting film 4. An opening 21, which pierces the insulating layer 6 and the second electrode 7 and exposes a part (electron-emitting portion) of the electron-emitting film 4, is provided. In the electron-emitting device of this constitution, when an electric potential higher than an electric potential of the conductive layer 2 is applied to the second electrode 7, electrons are emitted from the electron-emitting film 4. Therefore, the second electrode 7 generates an electric field necessary for emitting the electrons from the electron-emitting film 4. The second electrode 7 corresponds to so-called "extraction electrode" or "gate electrode". The shape of the opening 21 is not limited to a circular shape, and thus may be a rectangular or polygonal shape.

Figure 7A:
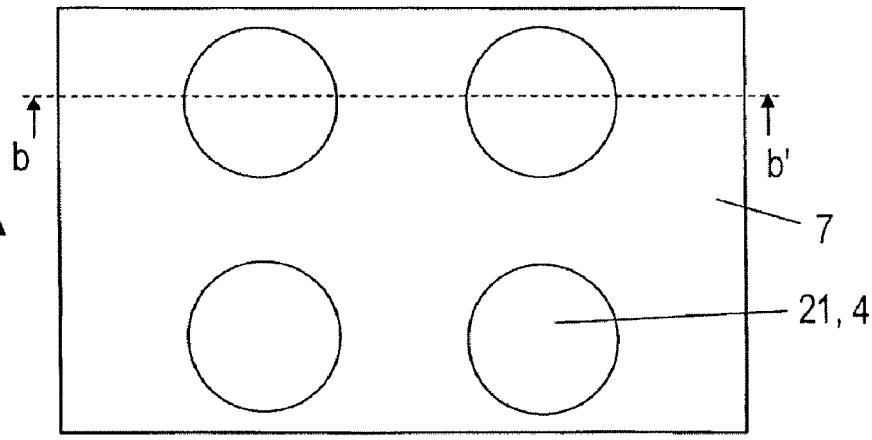
FIG. 7A is a plan view illustrating the electron-emitting device according to another embodiment.
Figure 7B:
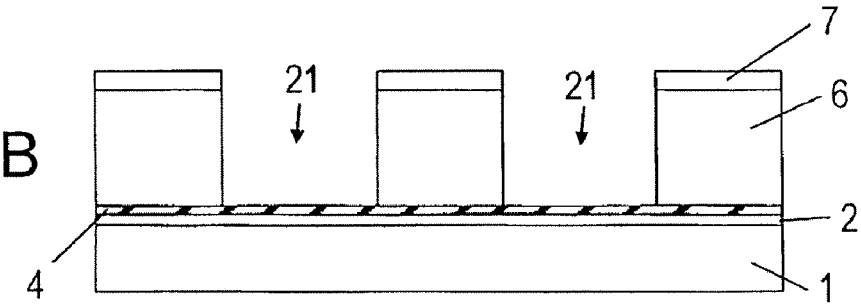
FIG. 7B is a sectional view taken along line b-b' of FIG. 7A.
Figure 7C:
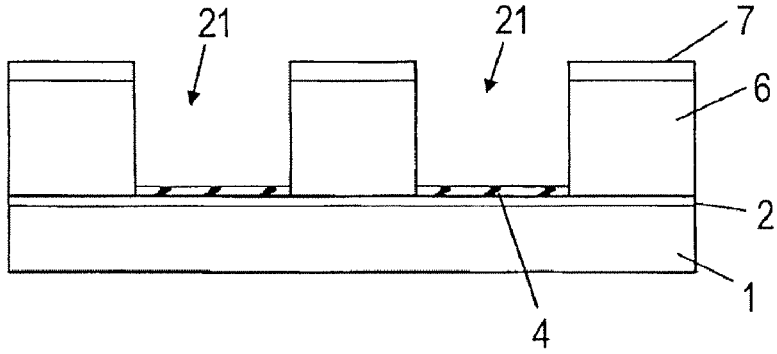
FIG. 7C illustrates a modified example.

FIGS. 7A and 7B illustrate another example of the electron-emitting device. FIG. 7A is a plan view, and FIG. 7B is a cross sectional view taken along line b-b' of FIG. 7A. In the example shown in FIGS. 2A and 2B, the electron-emitting device has one opening 21 (one electron-emitting portion), but in the example shown in FIGS. 7A and 7B, the electron-emitting device has a plurality of openings 21 (a plurality of electron-emitting portions). FIG. 7C illustrates a modified example of the electron-emitting device in FIG. 7B. In the electron-emitting device of FIG. 7C, the electron-emitting film 4 is arranged only in the openings 21.

<Emission of Electrons>

Figure 8:
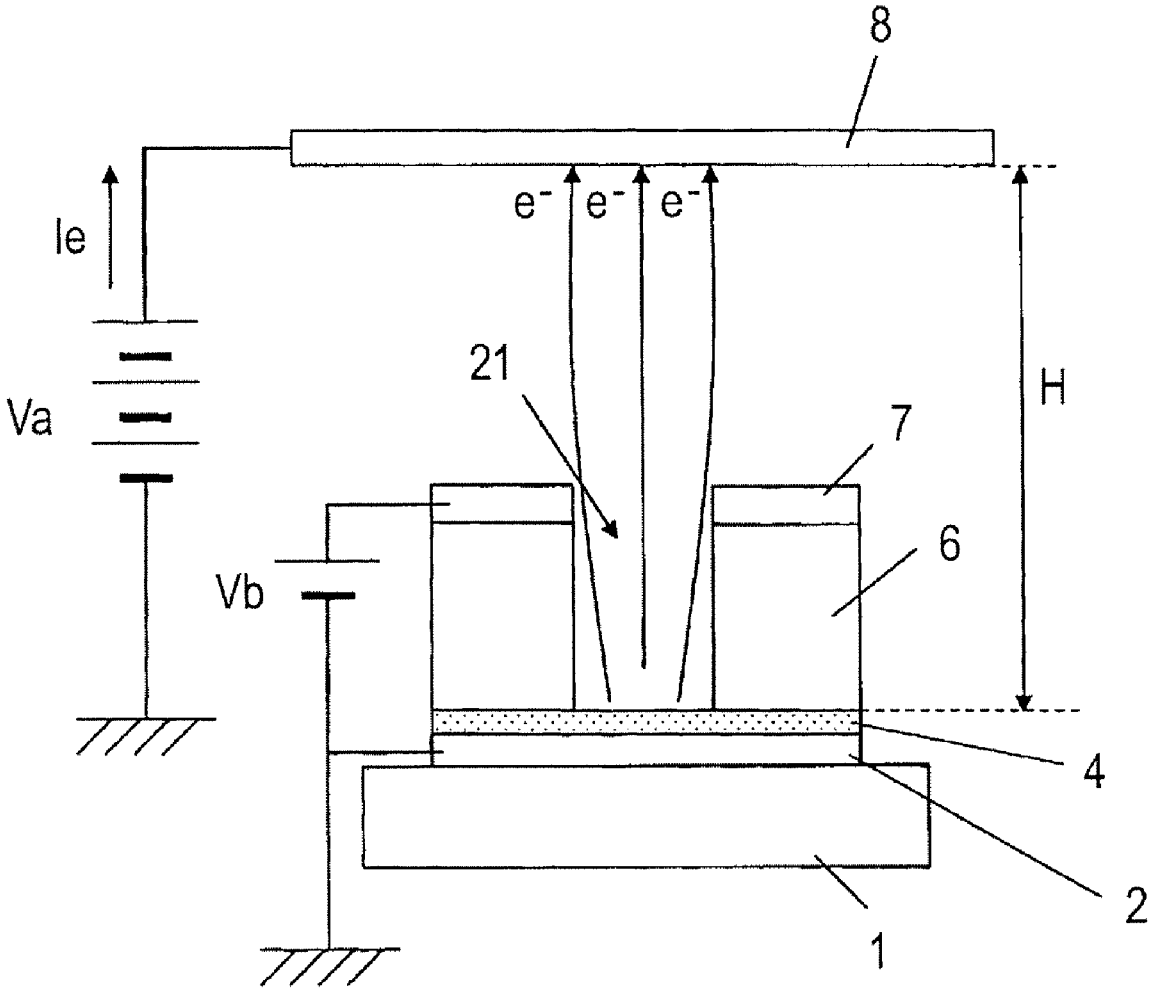
FIG. 8 is a view schematically illustrating an electron-emitting apparatus using the electron-emitting device.

The electron-emitting apparatus (including also an image display apparatus) using the electron-emitting device according to this embodiment generally adopts a triode structure (conductive layer (cathode electrode) 2, the second electrode (gate electrode) 7, and an anode electrode 8) as shown in FIG. 8, for example. The second electrode 7 is arranged between the conductive layer 2 and the anode electrode 8. The opening 21 of the second electrode 7 is formed so that a partial region of the conductive layer 2 is exposed to the anode electrode 8. The electron-emitting film 4 is provided at least on the partial region of the conductive layer 2 so as to be exposed in the openings 21. Needless to say, the anode electrode 8 is arranged so as to be opposed to the electron-emitting device shown in FIG. 1 without using the second electrode 7, so that the electron-emitting apparatus having a diode structure can be constituted.

In FIG. 8, the anode electrode 8 as a third electrode is arranged so as to be substantially parallel with the surface of the substrate 1 formed with the electron-emitting device shown in FIG. 2B. An electric potential higher than electric potentials of the electron-emitting film 4 and the second electrode 7 is applied to the anode electrode 8. At the time of driving, an electric potential higher than that of the electron-emitting film 4 is applied to the second electrode 7, so that electrons are emitted from the electron-emitting film 4. Typically, an electric potential higher than that of the conductive layer 2 is applied to the second electrode 7, and an electric potential sufficiently higher than that of the second electrode 7 is applied to the anode electrode 8. The emitted electrons pass through the openings 21, and are attracted to the anode electrode 8 so as to collide with the anode electrode 8.

<Method for Manufacturing the Electron-Emitting Device>

One example of the method for manufacturing the electron-emitting device according to this embodiment is described. The present invention is not particularly limited to this manufacturing method. That is to say, another manufacturing method may be used so as to manufacture the electron-emitting device according to the present invention.

The method for manufacturing the electron-emitting device according to an example shown in FIG. 2B is described with reference to FIGS. 3A to 3E.

(Step A)

Figure 3A:
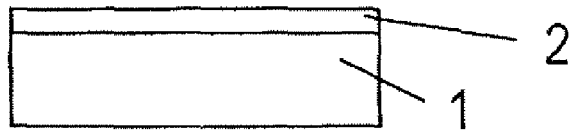
FIGS. 3A to 3E are views schematically illustrating examples of a method for manufacturing the electron-emitting device.

After the surface of the substrate 1 is sufficiently cleaned, the conductive layer 2 is provided on the surface (FIG. 3A). As the substrate 1, a soda lime glass, a laminated body obtained by laminating silicon oxide (typically $SiO_2$) on a silicon substrate, silica glass, glass in which a contained amount of impurities such as Na is reduced, or a ceramic insulating substrate such as alumina can be used.

The conductive layer 2 is composed of a material having conductive property. The conductive layer 2 can be formed by a general vacuum depositing technique such as a vacuum evaporation method, a sputtering method, or a photolithography technique. As the material of the conductive layer 2, any one is selected suitably from metal such as Be, Mg, Ti, Zr, Hf, V, Nb, Ta, Mo, W, Al, Cu, Ni, Cr, Au, Pt and Pd, and alloy materials containing these metals. In another example, any one can be selected suitably from carbide such as TiC, ZrC, Hfc, TaC, SiC and WC, boride such as $HfB_2$, $ZrB_2$, $LaB_6$, $CeB_6$, $YB_4$ and $GdB_4$, nitride such as TiN, ZrN and HfN, a semiconductor such as Si and Ge, amorphous carbon and graphite. A practical thickness of the conductive layer 2 is set within a range of not less than 10 nm and not more than 10 μm, and preferably selected within a range of not less than 100 nm and not more than 1 μm.

(Step B)

Figure 3B:
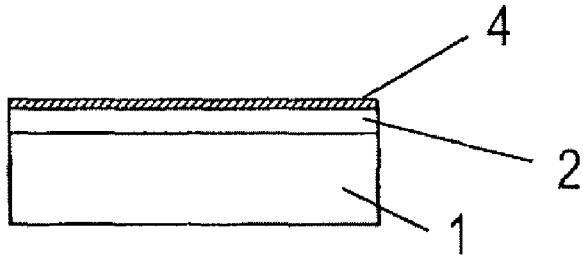

The electron-emitting film 4 is formed on the conductive layer 2 (FIG. 3B).

The electron-emitting film 4 can be formed by using the deposition technique such as the vacuum evaporation method, the sputtering method or the CVD method, but the manufacturing method is not particularly limited to them. However, particularly, the method for co-sputtering (simultaneously sputtering) the material of the base material layer 3 and the material of the particles 5 is preferable. A practical film thickness of the electron-emitting film 4 is set within a range of not less than 5 nm and not more than 500 nm, and preferably selected within a range of not less than 5 nm and not more than 50 nm. The electron-emitting film 4 is not formed at this stage, but after the opening 21 is formed, the electron-emitting film 4 may be selectively deposited on the conductive layer 2 exposed in the opening 21 (for example, the form shown in FIG. 7C).

The electron-emitting film 4 is composed of the base material layer 3 and the plurality of particles 5 arranged in the base material layer 3 as describe above. The materials and the electric resistivity of the base material layer 3 and the particles 5 are different from each other. The method for allowing the base material layer 3 to contain the plurality of particles 5 is not particularly limited, but preferably the base material layer 3 and the plurality of particles 5 may be formed by a single depositing process. When the single depositing process such as the co-sputtering method is used, an agglomeration step (particulating step) by means of heating like JP-A No. 2004-071536 (US 2006/0066199A1) can be eliminated. For this reason, undesired characteristic change and unexpected characteristic change which are caused by overshoot or the like in a heating process at the agglomeration step can be reduced. When the single depositing process is used, the manufacturing method can be simplified, thereby reducing the cost.

As the single depositing process, specifically, the co-sputtering method can be used. That is to say, a target (for example, Al) for forming the base material layer 3 made of the above-mentioned materials, and a target (for example Au) for forming the particles 5 made of the above materials are prepared. These two targets are co-sputtered in a mixed gas atmosphere containing oxygen and nitrogen. As a result, the electron-emitting film 4, in which the base material layer 3 made of oxynitride or the like contains the many particles 5, can be formed by the single depositing process without using a plurality of steps like the depositing step and the agglomeration step described in JP-A No. 2004-071536 (US 2006/0066199A1). Only when depositing conditions (a ratio of the oxygen gas to the nitrogen gas, and the like) in this depositing process is appropriately changed, the size of the particles 5 can be controlled and the electron-emitting film 4 having a desired electron emission characteristic can be easily formed.

(Step C)

Figure 3C:
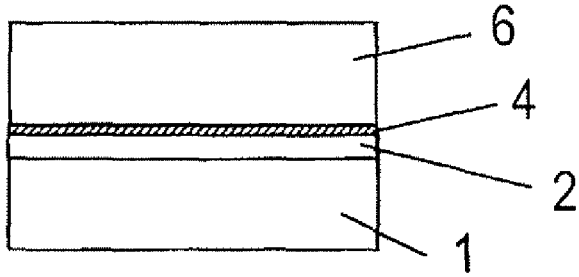

The insulating film 6 is deposited on the electron-emitting film 4 (FIG. 3C). The insulating film 6 is formed by the general vacuum depositing method such as the sputtering method, the CVD method or the vacuum evaporation method. A practical thickness of the insulating film 6 is set within a range of 5 nm to 50 μm, and is preferably selected from the range of 10 nm to 10 μm. Examples of desirable materials are silicon oxide, silicon nitride, alumina, calcium fluoride, and undoped diamond with high withstand pressure which are resistant to a high electric field.

(Step D)

Figure 3D:
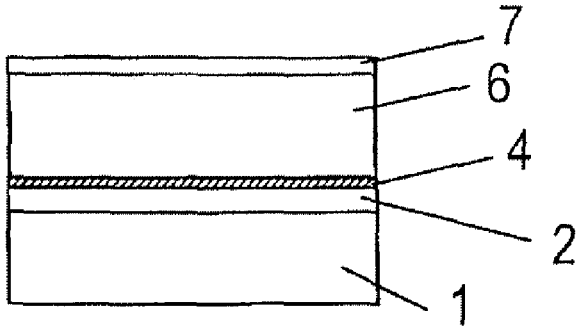

Further, the second electrode 7 is deposited after the insulating film 6 (FIG. 3D). The second electrode 7 has a conductive property similarly to the conductive layer 2. The second electrode 7 is formed by the general vacuum deposition technique such as the vacuum evaporation method and the sputtering method, or the photolithography technique. Examples of the materials of the second electrode 7 are metal such as Be, Mg, Ti, Zr, Hf, V, Nb, Ta, Mo, W, Al, Cu, Ni, Cr, Au, Pt and Pd, or alloyed materials, carbide such as TiC, ZrC, HfC, TaC, SiC and WC, boride such as $HfB_2$, $ZrB_2$, $LaB_6$, $CeB_6$, $YB_4$ and $GdB_4$, nitride such as TiN, ZrN and HfN, and semiconductor such as Si and Ge. A practical thickness of the second electrode 7 is set within a range of not less than 5 nm and not more than 1 μm, and preferably selected from the range of not less than 5 nm and not more than 200 nm. The second electrode 7 and the conductive layer 2 may be made of the same material or different materials. The second electrode 7 and the conductive layer 2 may be formed by the same forming method or different forming methods.

(Step E)

Figure 3E:
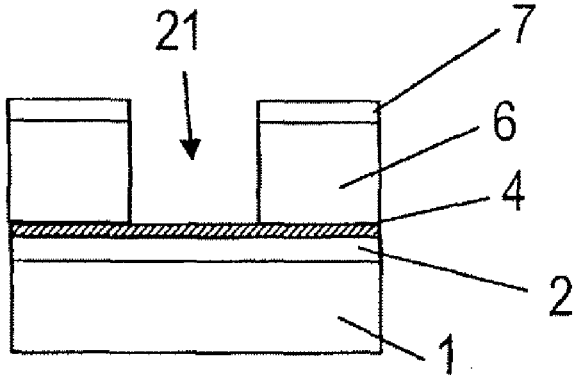

A mask (not shown) having a pattern (opening) for forming the opening 21 piercing the second electrode 7 and the insulating layer 6 is formed on the second electrode 7 by the photolithography technique or the like. The opening 21 which pierces the second electrode 7 and the insulating layer 6 and reaches an upper surface of the electron-emitting film 4 is formed by etching through the mask. Thereafter, the mask is removed (FIG. 3E). The etching method is not limited, and a planar shape of the opening 21 is not limited to a circular shape.

(Step F)

After the steps A to E are completed, a step for terminating the surface of the electron-emitting film 4 using hydrogen is preferably provided. When the surface of the electron-emitting film 4 is terminated with hydrogen, electrons are easily emitted from the surface of the electron-emitting film 4. Therefore, the electron emission characteristic of the electron-emitting device is further improved.

<Application Example of the Electron-Emitting Device>

The application example of the electron-emitting device is described below.

When a plurality of electron-emitting devices is arranged on the substrate, the electron source and the image display apparatus can be constituted.

Figure 4:
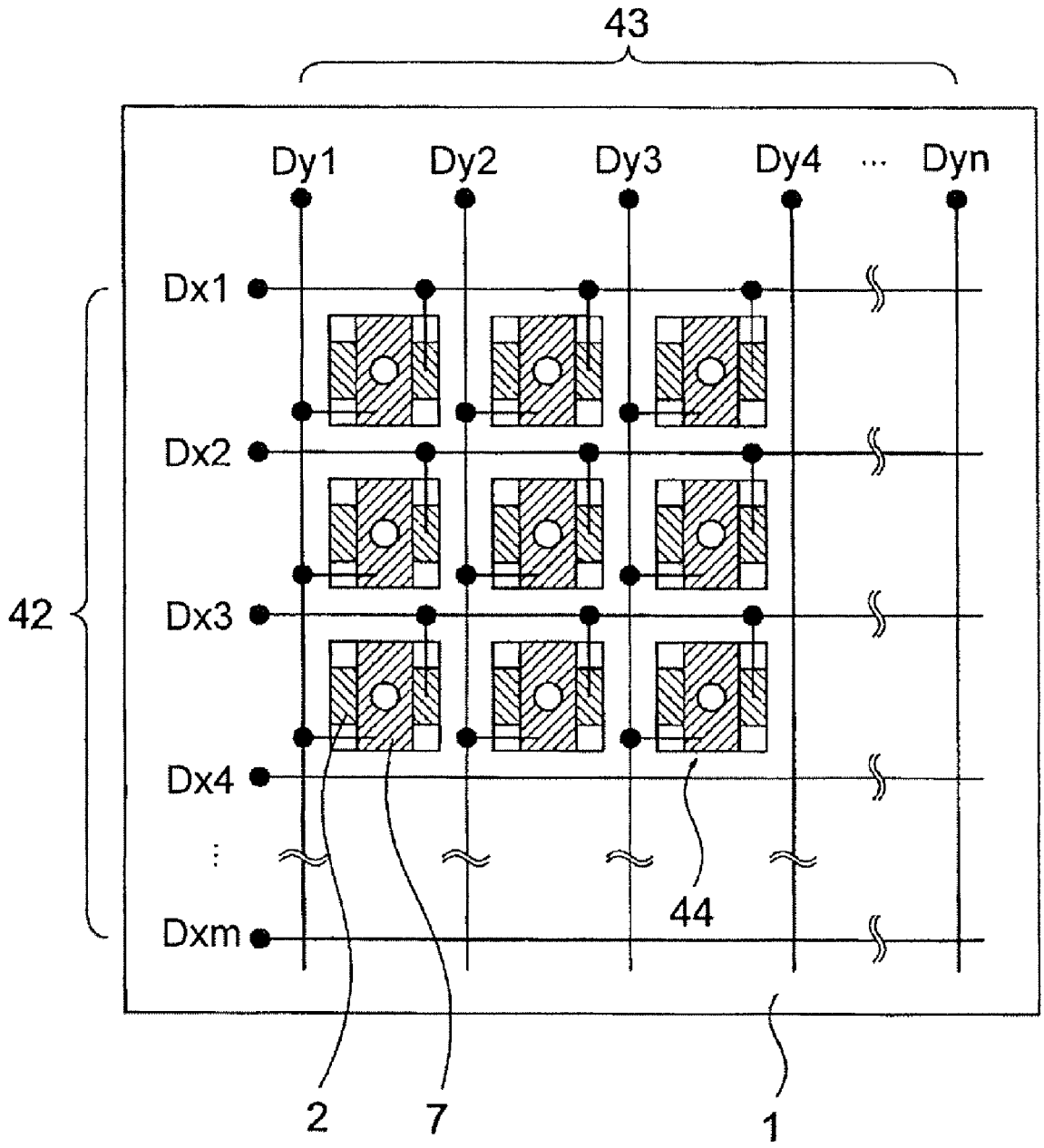
FIG. 4 is a plan view schematically illustrating a constitution of an electron source.

FIG. 4 is a schematic plan view illustrating the electron source having the plurality of electron-emitting devices. The plurality of electron-emitting devices 44 is arranged in X and Y directions into a matrix pattern. Numeral 42 denotes an x-direction wiring, and 43 denotes a y-direction wiring. The plurality of electron-emitting devices 44 shares the substrate 1.

The x-direction wiring 42 is composed of m wirings Dx1, Dx2, . . . Dxm. The x-direction wiring 42 can be made of a conductive material (typically, metal) formed by the vacuum evaporation method, a printing method, the sputtering method or the like. Material, thickness and width of the wirings are appropriately designed. The y-direction wiring 43 is composed of n wirings Dy1, Dy2, . . . Dyn, and is formed similarly to the x-direction wiring 42. An interlayer insulating layer, not shown, is provided between the m x-direction wiring 42 and the n y-direction wiring 43 so as to electrically separate them from each other. Both m and n are positive integers. The interlayer insulating layer, not shown, is composed of silicon oxide formed by the vacuum evaporation method, the printing method, the sputtering method or the like.

The conductive layer (cathode electrode) 2 of the electron-emitting device 44 is electrically connected to any one of the m x-direction wirings 42, and the second electrode (gate electrode) 7 is electrically connected to any one of the n y-direction wirings 43.

The x-direction wiring 42, the y-direction wiring 43, the conductive layer 2 and the second electrode 7 may be made of uniform materials or different materials. When the material of the conductive layer 2 is the same as the material of the x-direction wiring 42, the x-direction wiring 42 can be called also as the first electrode (cathode electrode). When the material of the second electrode 7 is the same as the material of the y-direction wiring 43, the y-direction wiring 43 can be called also as the second electrode (gate electrode).

The x-direction wiring 42 is connected with scan signal applying means (scan circuit), not shown, which applies a scan signal for selecting a line of the electron-emitting devices 44 arranged in the x direction. On the other hand, y-direction wiring 43 is connected with a modulation signal generating means (modulation circuit), not shown, which applies a modulation signal to each row of the electron-emitting devices 44 arranged in the y direction. A driving voltage applied to each electron-emitting device is defined as a difference voltage of the scan signal and the modulation signal applied to each of the devices. In the above constitution, individual electron-emitting devices are selected and can be driven independently.

Figure 5:
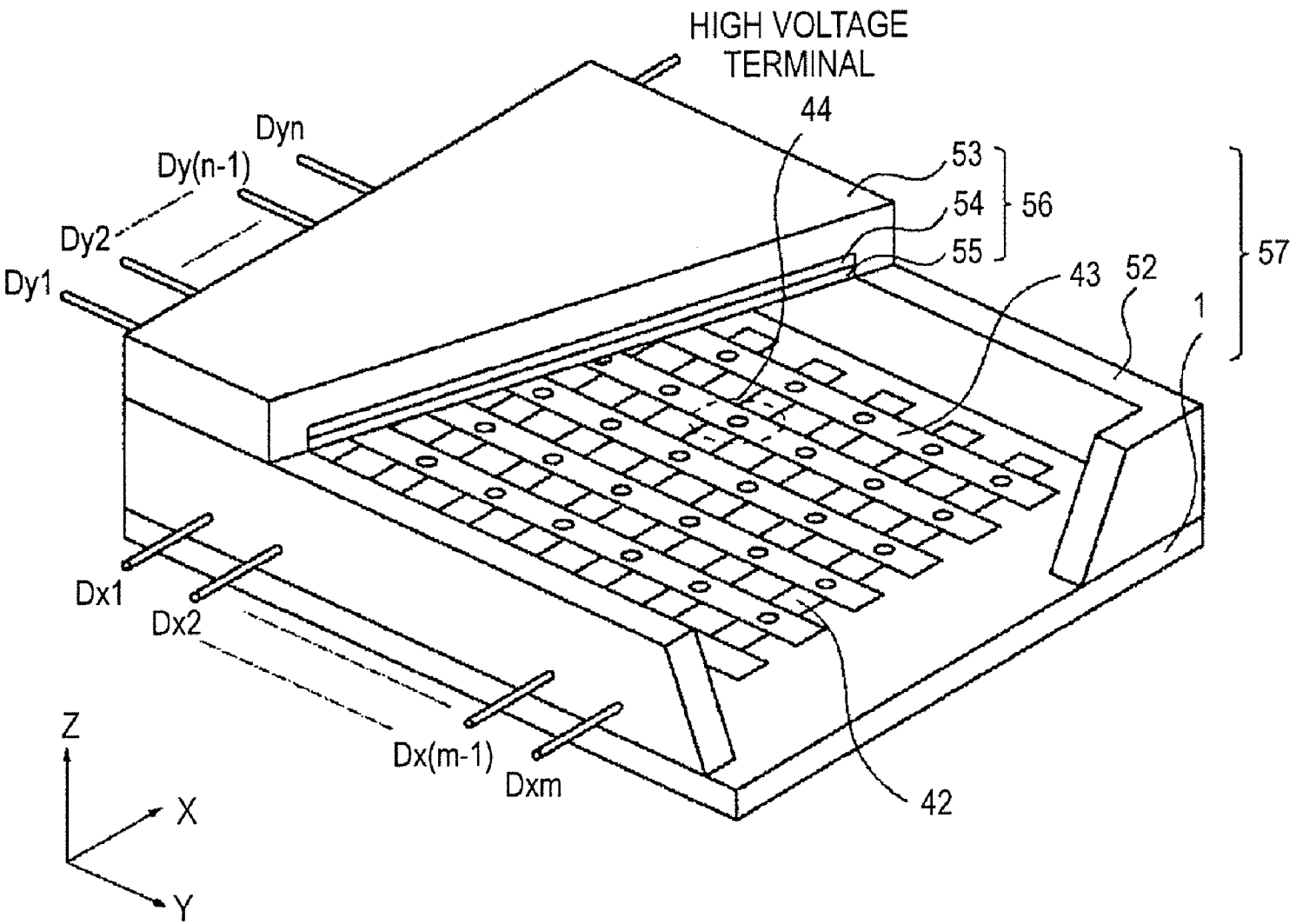
FIG. 5 is a perspective view schematically illustrating a constitution of a display panel.

The image display apparatus which is constituted by using the electron source of the matrix arrangement is descried with reference to FIG. 5. FIG. 5 is a view schematically illustrating one example of a display panel (occasionally called as "envelope") composing the image display apparatus 57.

The display panel 57 has the substrate (occasionally called as "rear plate") 1, a face plate 56, and a supporting frame 52. The face plate 56 has a transparent substrate 53, a light-emitting member 54 arranged on the inner surface of the substrate, and a conductive film (occasionally called as "metal back") 55 as an anode electrode. The light-emitting member 54 is a light-emitting body which emits light due to irradiation of electrons emitted from the electron source, and is composed of a fluorescent body of RGB, for example. The rear plate 1, the supporting frame 52 and the face plate 56 are sealed by adhesive such as frit glass, so that a sealed container is constituted. A supporting body, not shown, which is called as a spacer is provided between the face plate 56 and the rear plate 1, so that the display panel having sufficient strength against an air pressure can be also constituted.

Figure 9:
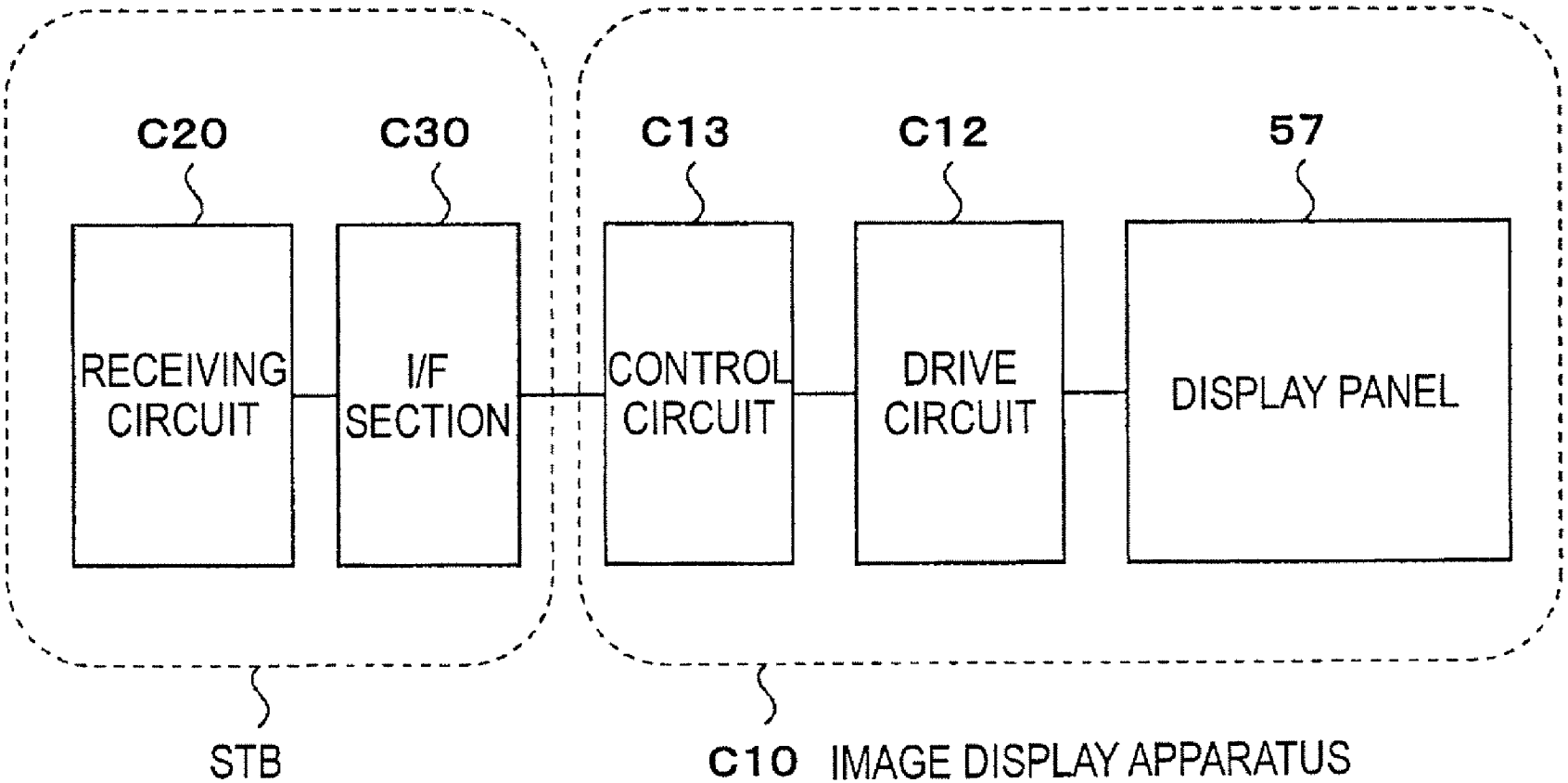
FIG. 9 is a block diagram illustrating a constitution of an information display/reproducing apparatus.

An information display/reproducing apparatus can be constituted by using this display panel (envelope) 57. The information display/reproducing apparatus outputs video information, text information, audio information and the like. FIG. 9 is a block diagram illustrating a television set as one example of the information display/reproducing apparatus. A receiving circuit C20 is composed of a tuner, a decoder and the like. The receiving circuit C20 receives a television signal of satellite broadcasting or terrestrial broadcasting, and data broadcasting or the like via a network such as internet so as to output decoded video data into an I/F section (interface section) C30. The I/F section C30 converts the video data into data having a display format of the image display apparatus C10. The image display apparatus C10 includes a display panel 57, a driving circuit C12 and a control circuit C13. The control circuit C13 gives an image process such as a correcting process suitable for the display panel 57 to the input image data, and outputs the image data and various control signals to the driving circuit C12. The driving circuit C12 outputs a driving signal to each wiring (see Dx1 to Dxm and Dy1 to Dyn in FIG. 5) of the display panel 57 based on the input image data. As a result, the electron-emitting devices are driven, and an image is displayed on the display panel 57. In an example of FIG. 9, the receiving circuit C20 and the I/F section C30 are housed in a case (set top box STB) separately from the image display apparatus C10. However, the circuits corresponding to the receiving circuit and the I/F section may be included in the image display apparatus C10.

The image display apparatus C10 may have an interface which is connected to an image recording apparatus (digital video camera, a digital camera, an HDD recorder, a DVD recorder or the like). As a result, images recorded in the image recording apparatus can be displayed on the display panel 57. The image display apparatus C10 may have an interface which is connected to an image output apparatus (printer, another display or the like). As a result, the image displayed on the display panel 57 is processed, if necessary, so as to be capable of being output to the image output apparatus.

Example 1

FIGS. 6A to 6F illustrate the method for manufacturing the electron-emitting device according to the Example 1.

(Step 1)

Figure 6A:
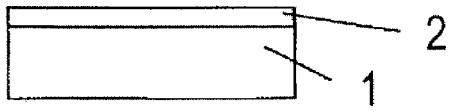
FIGS. 6A to 6F are views schematically illustrating a method for manufacturing the electron-emitting device according to an embodiment.

A quartz substrate was used as the substrate 1. After the substrate 1 was sufficiently cleaned, a TiN film was deposited as the conductive layer 2 on the substrate 1 into a thickness of 100 nm by the sputtering method (FIG. 6A). As atmosphere gas, gas obtained by mixing Ar gas and $N_2$ gas at a ratio of 9:1 was used, and the deposition was carried out under the following conditions.

Rf power source: 13.56 MHz

Rf output: 8 W/cm$^2$

Atmosphere gas pressure: 1.2 Pa

Target: Ti (Step 2)

Figure 6B:
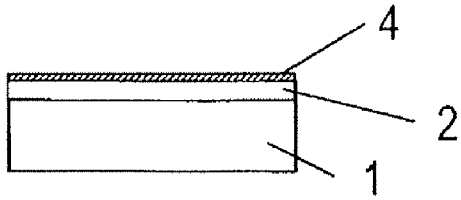

The electron-emitting film 4 was formed on the conductive layer 2 by the co-sputtering method (FIG. 6B). Al and Au were used as the targets, and a mixed gas of $O_2$ gas and $N_2$ gas at the ratio of 3:97 was used, so that deposition was carried out under the following conditions.

Rf power source: 13.56 MHz

Rf output applied to the Al target: 7.6 W/cm$^2$

Rf output applied to the Au target: 0.22 W/cm$^2$

Atmosphere gas pressure: 0.5 Pa

A plurality of particles was present in the deposited electron-emitting film 4 as shown in FIG. 1. The electron-emitting film 4 was observed by using TEM (transmission electron microscope), and was qualitatively analyzed by EDX (energy dispersion X-ray analyzer). As a result, it was confirmed that a main constituent of the electron-emitting film 4 was ALON, and the particles 5 was Au. The film thickness of the electron-emitting film 4 was 30 nm, and the size (diameter) of the particles 5 was 7.5 nm.

(Step 3)

Figure 6C:
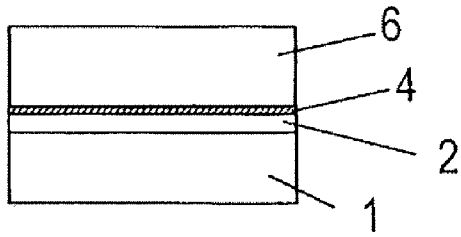

$SiO_2$ as the insulating layer 6 was deposited on the electron-emitting film 4 into 1000 nm by the plasma CVD method (FIG. 6C).

(Step 4)

Figure 6D:
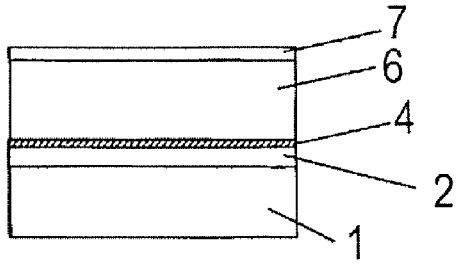

Pt as the second electrode 7 was deposited on the insulating layer 6 so as to have a thickness of 100 nm (FIG. 6D).

(Step 5)

The second electrode 7 was spin coated with a positive photoresist, and a photomask pattern (circular) was exposed and developed so that a mask pattern, not shown, was formed. The mask pattern had a circular opening. An opening diameter at this time was 1.5 μm. As to the number of the openings, a plurality of openings may be formed as shown in FIG. 7, but the number is not particularly limited.

(Step 6)

Figure 6E:
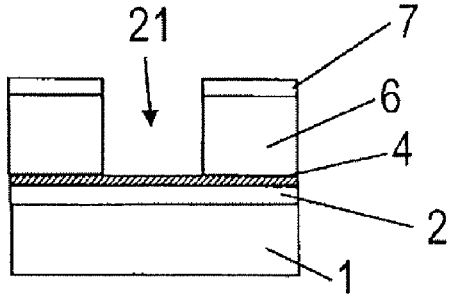

The second electrode 7 and the insulating layer 6 positioned just below the opening of the mask pattern were etched by dry etching until the surface of the electron-emitting film 4 was exposed, and the opening 21 was formed (FIG. 6E).

(Step 7)

A residual mask pattern (not shown) was eliminated by peeling liquid, and was rinsed by water.

(Step 8)

Figure 6F:
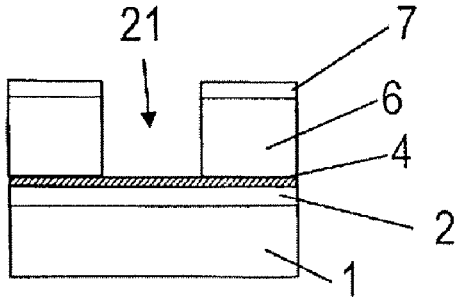

The substrate 1 was heated at 550° C. for 300 minutes in a mixed gas atmosphere of acetylene and hydrogen, so that an ALON film containing the Au particles 5 (namely, the electron-emitting film 4) was formed (FIG. 6F).

The electron-emitting device according to the Example 1 was completed by the above-described steps.

The electron emission characteristic of the electron-emitting device manufactured in such a manner was measured. At the time of measurement, as shown in FIG. 8, the anode electrode 8 was arranged above the electron-emitting device manufactured in this embodiment. Electric potentials were applied to the anode electrode 8, the conductive layer 2 and the second electrode 7, respectively, and an electron emission amount was measured. The applied voltages were Va=10 kV and Vb=20 V, and a distance H between the electron-emitting film 4 and the anode electrode 8 was 2 mm.

On the other hand, as comparative examples, the electron-emitting device in which an aluminum oxide film containing a lot of Au particles was used as the electron-emitting film, and the electron-emitting device in which an aluminum nitride film containing a lot of Au particles was used as the electron-emitting film were manufactured. Both the electron-emitting films were formed by the co-sputtering method, but the particles size of the Au particles was smaller than 1 nm. On the other hand, in the film according to the Example 1, the Au particles having a predetermined larger particles size were formed stably.

As to the stability of the electron emission characteristic, a lot of electron-emitting devices were manufactured under the same conditions, and dispersion of their electron emission amount was evaluated. As to the fluctuation in the electron emission amount, data about the electron emission amount were acquired every couple of minutes, and the fluctuation ($\sigma/\mu$) electron emission amount was evaluated.

As a result, in conventional electron-emitting devices having small particles size, reproducibility of the electron emission characteristic was insufficient (dispersion among the devices was large), and the stability was not good. On the contrary, the electron-emitting devices in the Example 1 had approximately uniform electron emission characteristic, and high stability was realized. In comparison with conventional electron-emitting devices, the fluctuation in the electron emission amount of the electron-emitting devices according to the Example 1 was sufficiently small.

Example 2

The method for manufacturing the electron-emitting device according to the Example 2 is described with reference to FIGS. 6A to 6F.

(Step 1)

A quartz substrate was used as the substrate 1. After the substrate 1 was sufficiently cleaned, a TiN film as the conductive layer 2 was deposited on the substrate 1 by the sputtering method so as to have a thickness of 100 nm (FIG. 6A). As atmosphere gas, gas obtained by mixing Ar gas and $N_2$ gas at a ratio of 9:1 was used, and the deposition was carried out under the following conditions.

Rf power source: 13.56 MHz

Rf output: 8 W/cm$^2$

Atmosphere gas pressure: 1.2 Pa

Target Ti (Step 2)

The electron-emitting film 4 was formed on the conductive layer 2 by the co-sputtering method (FIG. 6B). Al and Ir were used as the targets, and a gas obtained by mixing $O_2$ gas and $N_2$ gas at a ratio of 3:97 was used, and the deposition was carried out under the following conditions.

Rf power source: 13.56 MHz

Rf output applied to the Al target: 7.6 W/cm$^2$

Rf output applied to the Ir target: 0.15 W/cm$^2$

Atmosphere gas pressure: 0.5 Pa

A plurality of particles was present in the deposited electron-emitting film 4 as shown in FIG. 1. The electron-emitting film 4 was observed by TEM (transmission electron microscope), and was qualitatively analyzed by EDX (energy dispersion X-ray analyzer). It was confirmed that a main constituent of the electron-emitting film 4 was AlON and the particles 5 was Ir. The film thickness of the electron-emitting film 4 was 30 nm, and the particle size (diameter) of the particles 5 was 1.0 nm.

(Step 3)

$SiO_2$ as the insulating layer 6 was deposited into 1000 nm on the electron-emitting film 4 by the plasma CVD method (FIG. 6C).

(Step 4)

Pt was deposited as the second electrode 7 on the insulating layer 6 so as to have a thickness of 100 nm (FIG. 6D).

(Step 5)

The second electrode 7 was spin-coated with positive photoresist, and a photomask pattern (circular) was exposed and developed. A mask pattern, not shown, was formed. The mask pattern had a circular opening. An opening diameter at this time was 1.5 μm. As to the number of openings, a plurality of openings may be formed as shown in FIG. 7, but the number is not particularly limited.

(Step 6)

The second electrode 7 and the insulating layer 6 positioned just below the opening of the mask pattern were etched by dry etching until the surface of the electron-emitting film 4 was exposed, and the opening 21 was formed (FIG. 6E).

(Step 7)

A residual mask pattern (not shown) was removed by peeling liquid, and was rinsed by water.

(Step 8)

The substrate 1 was heated at 550° C. for 300 minutes in a mixed gas atmosphere of acetylene and hydrogen, and an AlON film, containing the Ir particles 5 (namely, the electron-emitting film 4) whose surface was terminated with hydrogen, was formed (FIG. 6F).

The electron-emitting device according to the Example 2 was completed by the above-described steps.

The electron emission characteristic of the electron-emitting device manufactured in such a manner was measured by the method similar to that of the Example 1. It was confirmed that the electron-emitting device of the Example 2 also had the stable electron emission characteristic, and the fluctuation in the electron emission amount was also small.

Further, for comparison of the fluctuation in the electron emission amount, an electron-emitting device CE, in which a base material of the electron-emitting film formed at the step 2 was AlO (oxide) and its particles were Ir, was manufactured as a comparative example. The sputtering conditions are as follows. Al and Ir were used as the targets, and $O_2$ gas was used.

Rf power source: 13.56 MHz

Rf output applied to the Al target: 7.6 W/cm$^2$

Rf output applied to the Ir target: 0.15 W/cm$^2$

Atmosphere gas pressure: 0.5 Pa

A plurality of particles was present in the deposited electron-emitting film. The electron-emitting film 4 was observed by TEM (transmission electron microscope), and was qualitatively analyzed by EDX (energy dispersion X-ray analyzer). As a result, it was confirmed that a main constituent of the electron-emitting film was AlO and the particles were Ir. The film thickness of the electron-emitting film was 30 nm, and the particle size (diameter) of the particles was 0.6 nm.

The electron-emitting device CE was the same as the electron-emitting device in the Example 2 except for the particle size of the Ir particles and the base material layer formed by AlO.

The fluctuation in the electron emission amount of the electron-emitting device in the Example 2 was compared with the fluctuation in the electron emission amount of the electron-emitting device CE in the comparative example. The fluctuation in the electron emission amount of the electron-emitting device in the Example 2 was very small.

Example 3

The method for manufacturing the electron-emitting device according to the Example 3 is described with reference to FIGS. 6A to 6F.

(Step 1)

A quartz substrate was used as the substrate 1. After the substrate 1 was sufficiently cleaned, a TiN film as the conductive layer 2 was deposited into a thickness of 100 nm on the substrate 1 by the sputtering method (FIG. 6A). Gas obtained by mixing Ar gas and $N_2$ gas at a ratio of 9:1 was used as the atmosphere gas, and the deposition was carried out under the following conditions.

Rf power source: 13.56 MHz

Rf output: 8 W/cm$^2$

Atmosphere gas pressure: 1.2 Pa

Target: Ti (Step 2)

The electron-emitting film 4 was formed on the conductive layer 2 by the co-sputtering method (FIG. 6B). Al and Ag were used as the targets, and gas obtained by mixing $O_2$ gas and $N_2$ gas at a ratio of 3:97 was used, and the deposition was carried out under the following conditions.

Rf power source: 13.56 MHz

Rf output applied to the Al target: 7.6 W/cm$^2$

Rf output applied to the Ag target: 0.30 W/cm$^2$

Atmosphere gas pressure: 0.5 Pa

A plurality of particles was present in the deposited electron-emitting film 4 as shown in FIG. 1. The electron-emitting film 4 was observed by TEM (transmission electron microscope), and was qualitatively analyzed by EDX (energy dispersion X-ray analyzer). It was confirmed that a main constituent of the electron-emitting film 4 was AlON and the particles 5 were Ag. The film thickness of the electron-emitting film 4 was 30 nm, and the particle size (diameter) of the particles 5 was 9.5 nm.

(Step 3)

$SiO_2$ as the insulating layer 6 was deposited into 1000 nm on the electron-emitting film 4 by the plasma CVD method (FIG. 6C).

(Step 4)

Pt as the second electrode 7 was deposited into a thickness of 100 nm on the insulating layer 6 (FIG. 6D).

(Step 5)

The second electrode 7 was spin coated with positive photoresist, and a photomask pattern (circular) was exposed and developed. The mask pattern, not shown, was formed. The mask pattern had a circular opening. An opening diameter at this time was 1.5 μm. As to the number of the openings, a plurality of openings may be formed as shown in FIG. 7, and the number is not particularly limited.

(Step 6)

The second electrode 7 and the insulating layer 6 positioned just below the opening of the mask pattern were etched by dry etching until the surface of the electron-emitting film 4 was exposed, so that the opening 21 was formed (FIG. 6E).

(Step 7)

A residual mask pattern (not shown) was eliminated by peeling liquid, and was rinsed by water.

(Step 8)

The substrate 1 was heated at 550° C. for 300 minutes in the mixed gas atmosphere of acetylene and hydrogen, and an AlON film containing the Ag particles 5 (namely, the electron-emitting film 4) was formed (FIG. 6F).

The electron-emitting device according to the Example 3 is completed by the above-described steps.

The electron emission characteristic of the electron-emitting device manufactured in such a manner was measured by the method similar to that of the Example 1. It was confirmed that the electron-emitting device of the Example 3 had the stable electron emission characteristic and the fluctuation in the electron emission amount was small.

Example 4

The display panel 57 shown in FIG. 5 was manufactured by using the electron-emitting device manufactured in the Example 3.

The one-hundred electron emitting devices 44 were arranged in the x direction and y direction, respectively, into a matrix. The x-direction wirings 42 (Dx1 to Dxm) were connected to the conductive layer 2 as shown in FIG. 5, and the y-direction wirings 43 (Dy1 to Dyn) were connected to the second electrode 7. An light-emitting member 54 and a metal back 55 as an anode electrode were arranged above the electron source (rear plate 1). FIG. 5 illustrates an example where one opening is formed on one electron-emitting device 44, but the number of openings is not limited to one, and a plurality of openings may be provided.

The rear plate 1 and the face plate 56 were sealed into the supporting frame 52 by using indium as adhesive. As a result, the display panel 57, which can be driven in a simple-matrix and can display stable images for a long period with high definition and less luminance dispersion, was obtained. A driving circuit or the like was connected to the display panel 57 so that the satisfactory image display apparatus was obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-124315, filed on May 9, 2007, which is hereby incorporated by reference herein in its entirety.

What is claimed is:

1. An electron-emitting device comprising an electron-emitting film, wherein the electron-emitting film is a film which has a first layer made of a first material, and a plurality of particles, which is made of a second material whose electric resistivity is lower than that of the first material and is provided in the first layer, the first material is a material containing oxygen and nitrogen, and the second material is a material containing at least one of Ag and Ir.

2. An electron-emitting device according to claim 1, wherein a surface of the electron-emitting film is terminated with hydrogen.

3. An electron-emitting device according to claim 1, wherein the first material is oxynitride, oxide doped with nitrogen or nitride doped with oxygen.

4. An electron-emitting device according to claim 1, wherein the first material is a material containing SiOxNy, GeOxNy or AlOxNy.

5. An electron-emitting device according to claim 4, wherein the first material is a material containing GeOxNy.

6. An electron-emitting device according to claim 1, wherein a particle diameter of the particles is not less than 1 nm and not more than 10 nm.

7. An electron-emitting device according to claim 1, further comprising:

a cathode electrode, and a gate electrode which is arranged between the cathode electrode and an anode electrode, wherein the gate electrode has an opening for exposing a partial region of the cathode electrode to the anode electrode, the electron-emitting film is provided at least to the partial region of the cathode electrode exposed by the opening.

8. An electron source comprising:

a plurality of electron-emitting devices, wherein the electron-emitting device is the electron-emitting device according to claim 1.

9. An image display apparatus comprising:

an electron source; and a light-emitting member which emits light by means of electrons emitted from the electron source, wherein the electron source is the electron source according to claim 8.

* * * * *